US011020785B2

(12) United States Patent
Saito et al.

(10) Patent No.: US 11,020,785 B2
(45) Date of Patent: Jun. 1, 2021

(54) METHOD AND APPARATUS FOR MANUFACTURING PRESS COMPONENT

(71) Applicant: NIPPON STEEL & SUMITOMO METAL CORPORATION, Tokyo (JP)

(72) Inventors: Masahiro Saito, Tokyo (JP); Ryuichi Nishimura, Tokyo (JP); Yasuharu Tanaka, Tokyo (JP); Takashi Miyagi, Tokyo (JP); Takashi Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 401 days.

(21) Appl. No.: 15/741,345

(22) PCT Filed: Jun. 27, 2016

(86) PCT No.: PCT/JP2016/069009

§ 371 (c)(1),
(2) Date: Jan. 2, 2018

(87) PCT Pub. No.: WO2017/006793

PCT Pub. Date: Jan. 12, 2017

(65) Prior Publication Data

US 2018/0185899 A1 Jul. 5, 2018

(30) Foreign Application Priority Data

Jul. 6, 2015 (JP) ..... JP2015-135367

(51) Int. Cl.

| | |
|---|---|
| ***B21D 22/26*** | (2006.01) |
| ***B21D 22/22*** | (2006.01) |
| ***B21D 24/04*** | (2006.01) |
| ***B21D 22/06*** | (2006.01) |
| ***B21D 53/88*** | (2006.01) |

(52) U.S. Cl.
CPC ..... *B21D 22/26* (2013.01); *B21D 22/06* (2013.01); *B21D 22/22* (2013.01); *B21D 24/04* (2013.01); *B21D 53/88* (2013.01)

(58) Field of Classification Search
CPC ..... B21D 22/06; B21D 22/26; B21D 22/22; B21D 22/02; B21D 22/10; B21D 22/24; B21D 24/04; B21D 24/00; B21D 53/88
(Continued)

(56) References Cited

U.S. PATENT DOCUMENTS 7,322,222 B2 * 1/2008 Kodaka ..... B21D 22/22 72/309
2012/0297853 A1 * 11/2012 Tanaka ..... B21D 22/02 72/350
(Continued)

FOREIGN PATENT DOCUMENTS

CN 102791396 11/2012
CN 103237611 8/2013
(Continued)

OTHER PUBLICATIONS

Translation of JP 2551022 (Year: 1996).*

*Primary Examiner* — Shelley M Self
*Assistant Examiner* — Teresa A Guthrie
(74) *Attorney, Agent, or Firm* — Clark & Brody LP

(57) ABSTRACT

A method and apparatus for manufacturing a press component without generating cracks in a flange on an inner circumferential side of a curved portion includes press working by a free bending method on a blank consisting of an ultra-high tensile strength steel sheet. A press component is manufactured by performing cold press working on a blank of an ultra-high tensile strength steel sheet. By the press working, a material inflow facilitating portion that increases the amount by which a portion of the blank to be formed into an end portion of the press component flows into
(Continued)

a portion of the blank to be formed into a flange on an inner circumferential side of the curved portion of the press component is provided in the vicinity of the portion of the blank to be formed into the flange on an inner circumferential side of the curved portion of the press component.

16 Claims, 14 Drawing Sheets

(58) Field of Classification Search
USPC ..... 72/374
See application file for complete search history.

(56) References Cited

U.S. PATENT DOCUMENTS

2015/0343514 A1* 12/2015 Inoue ..... B21D 22/26 228/173.7
2016/0082495 A1 3/2016 Miyagi et al.
2016/0354825 A1* 12/2016 Shinmiya ..... B21D 22/02

FOREIGN PATENT DOCUMENTS

| | | | |
|---|---|---|---|
| CN | 204035335 | | 12/2014 |
| JP | 06-218440 | | 8/1994 |
| JP | 2551022 | B2 * | 11/1996 |
| JP | 2003-103306 | | 4/2003 |
| JP | 2006-015404 | | 1/2006 |
| JP | 2009-255116 | | 11/2009 |
| JP | 2011-050971 | | 3/2011 |
| JP | 2014-117728 | | 6/2014 |
| RU | 2057606 | | 4/2004 |
| SU | 776712 | | 11/1980 |
| SU | 1329868 | | 8/1987 |
| WO | 20111145679 | | 11/2011 |
| WO | 2014/185428 | | 11/2014 |

* cited by examiner

[Figure 1]
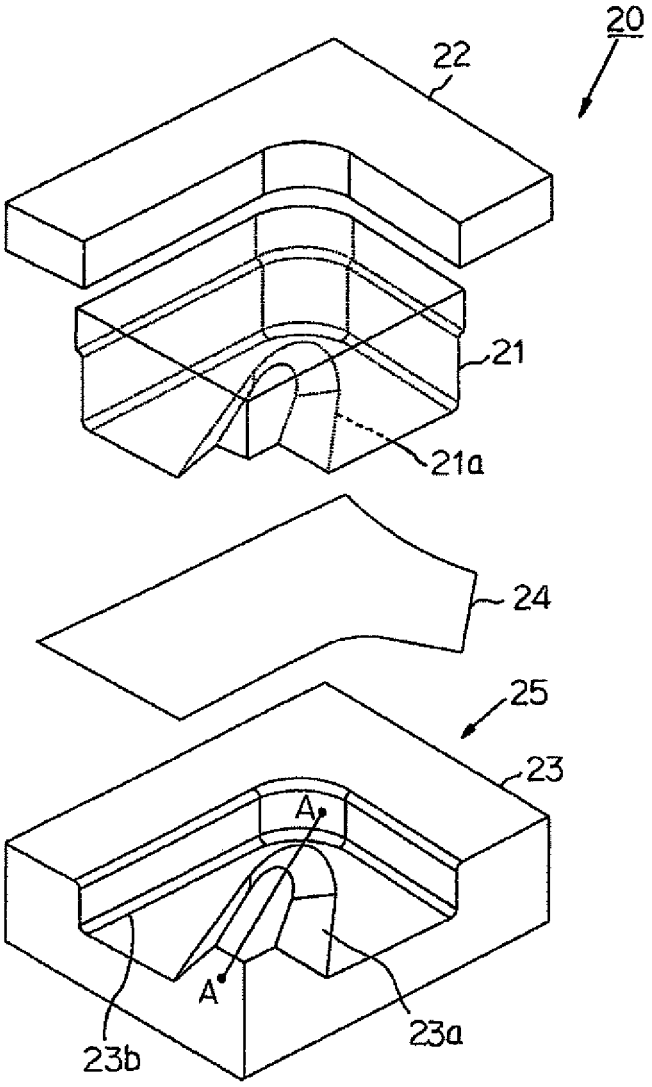

[Figure 2]
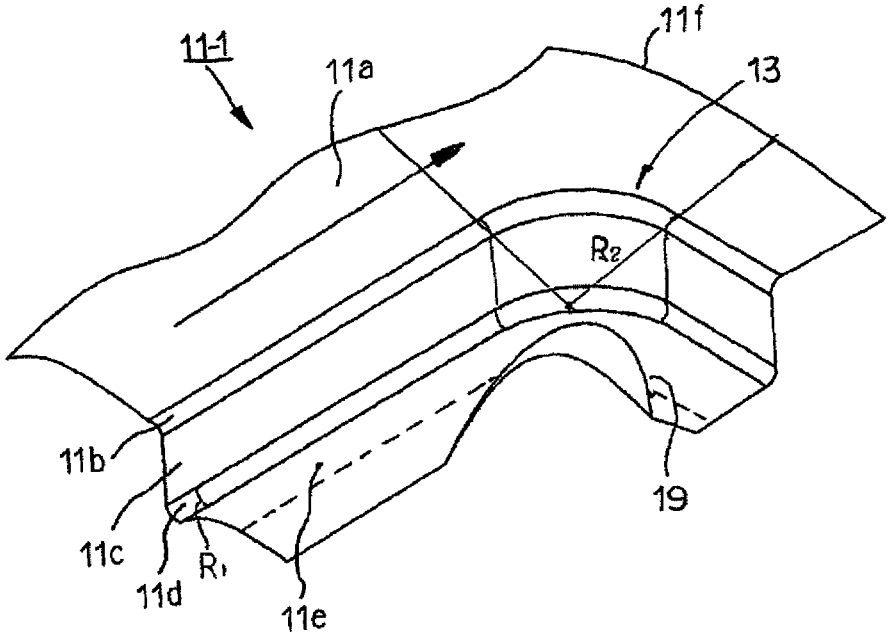
[Figure 3]
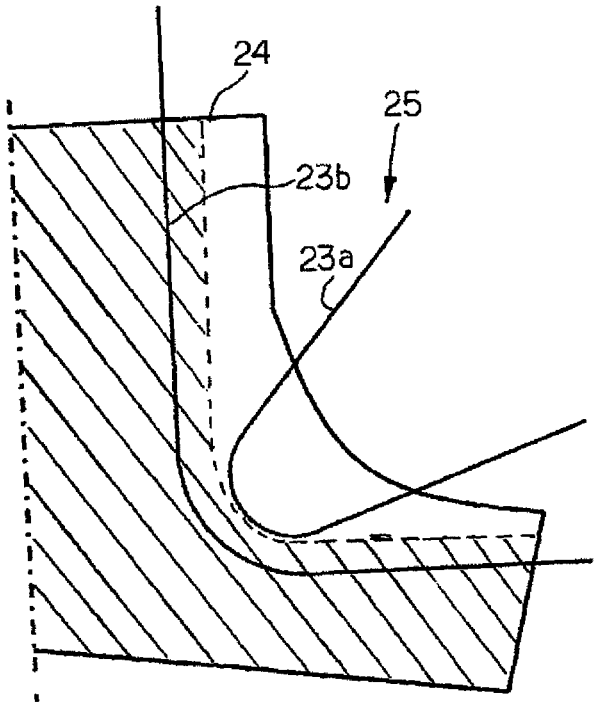

[Figure 4]
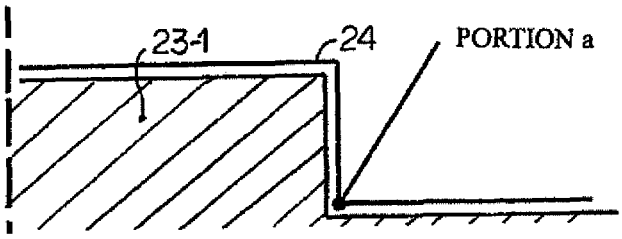
[Figure 5]
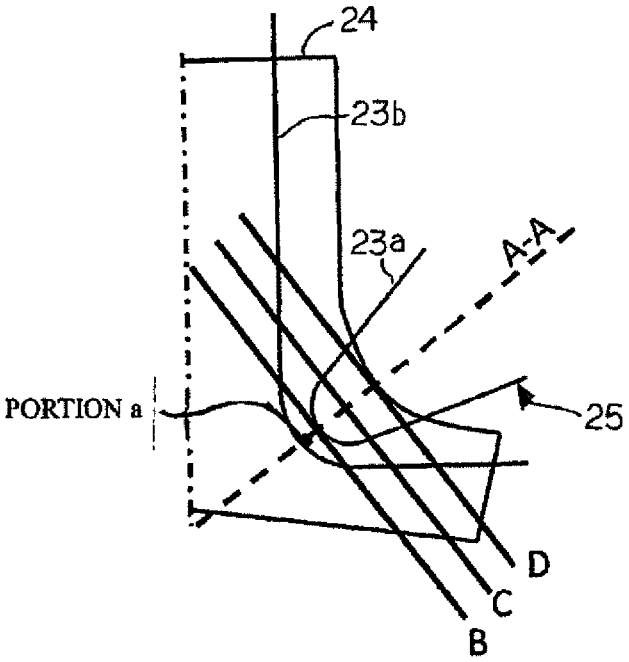

[Figure 6]
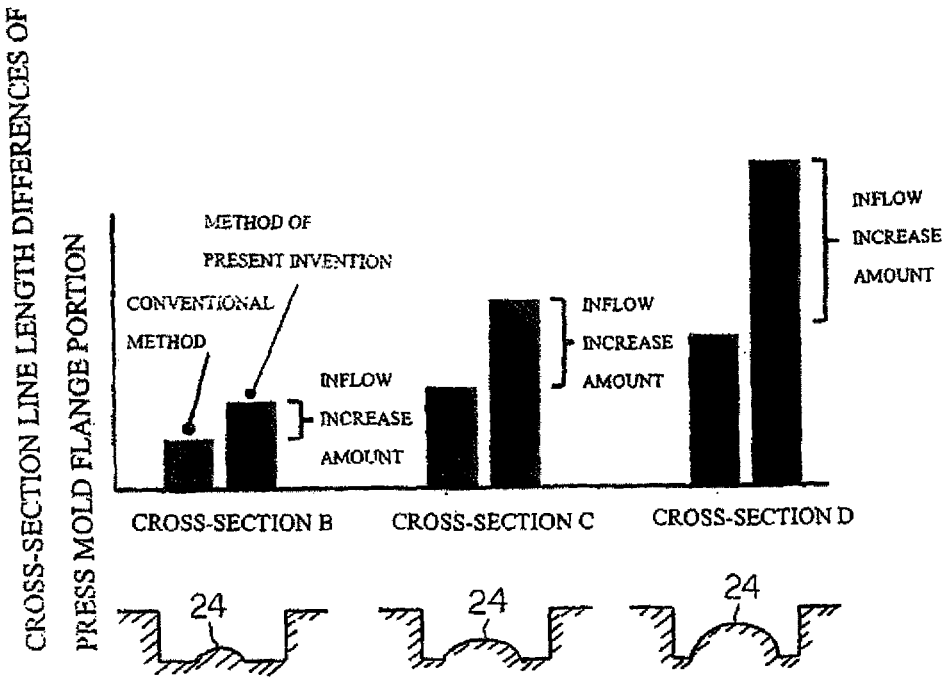
[Figure 7]
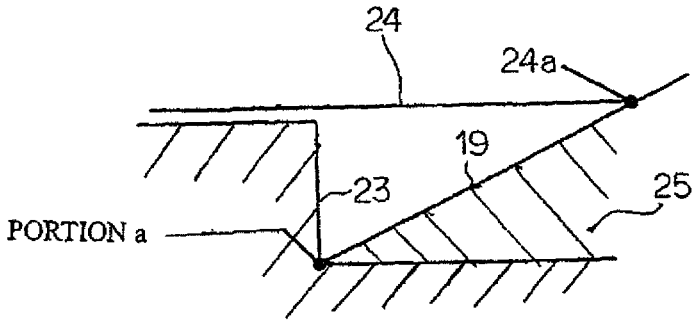

[Figure 8]
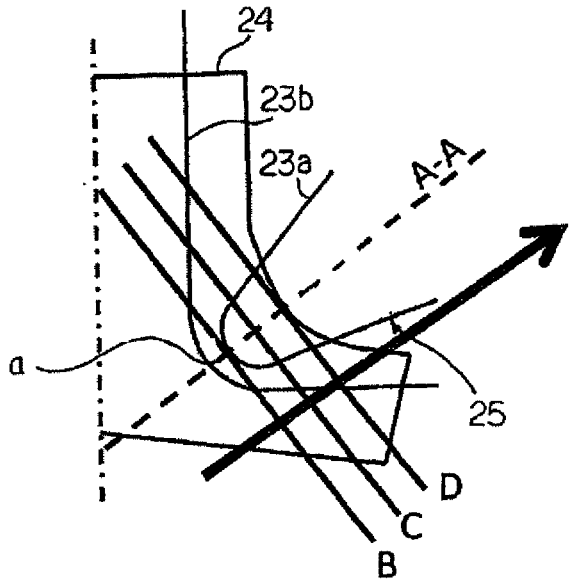
[Figure 9]
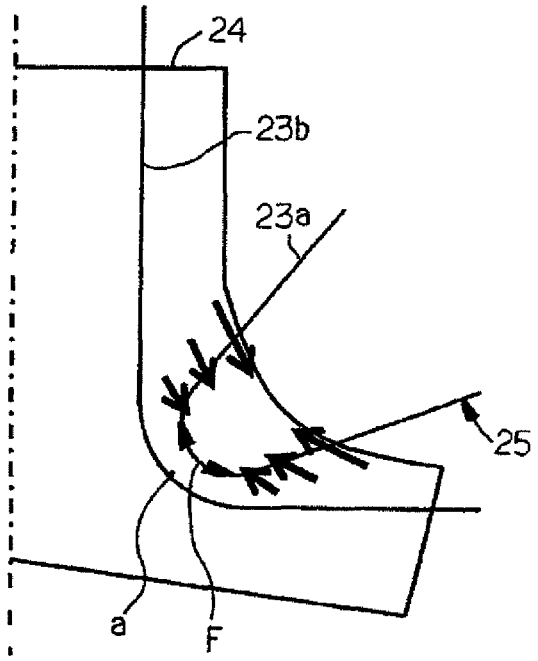

[Figure 12]
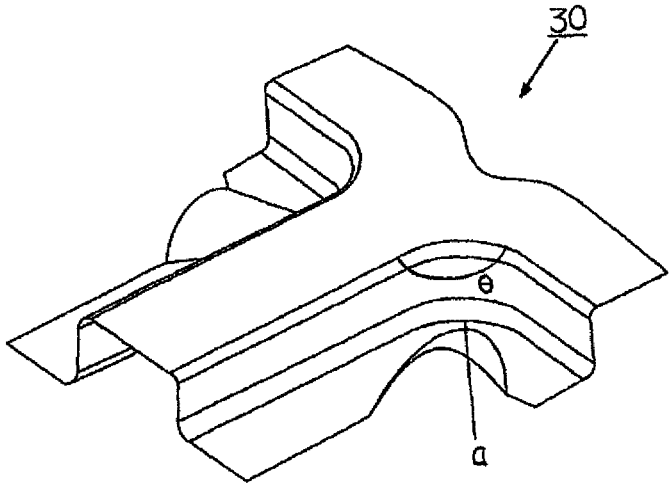
[Figure 13]
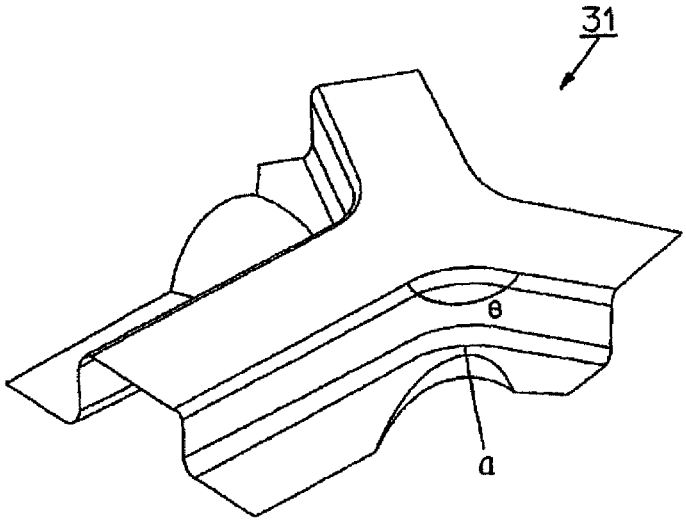

[Figure 14]
PRIOR ART
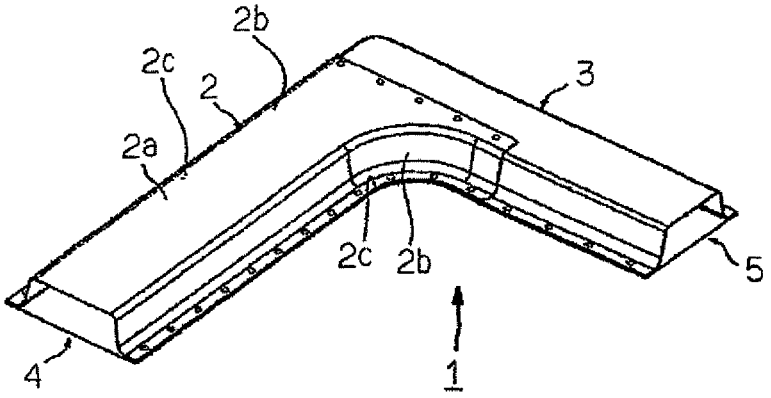

[Figure 15]
PRIOR ART
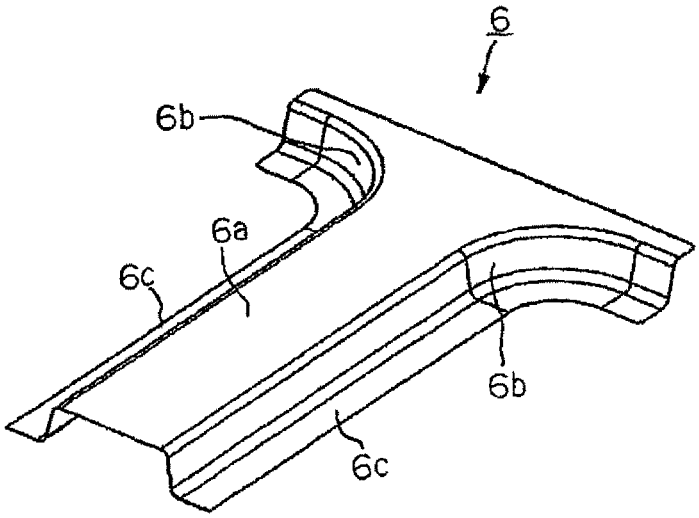
[Figure 16]
PRIOR ART
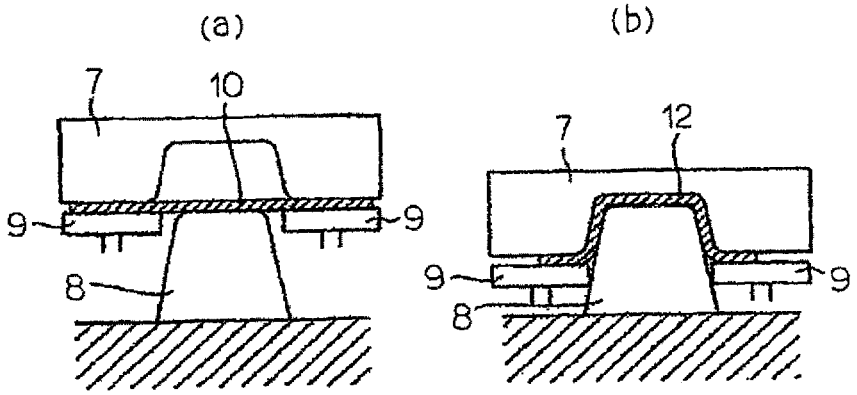

[Figure 17]
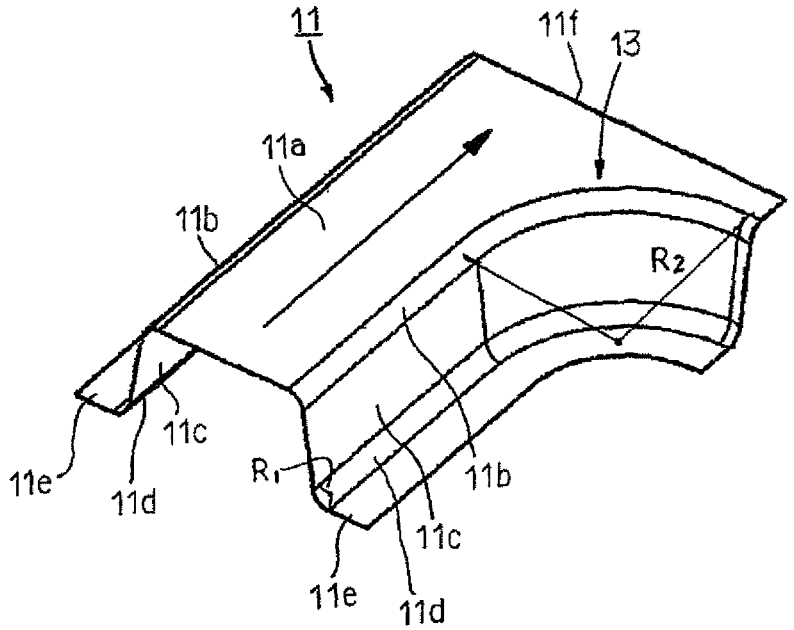
PRIOR ART
[Figure 18]
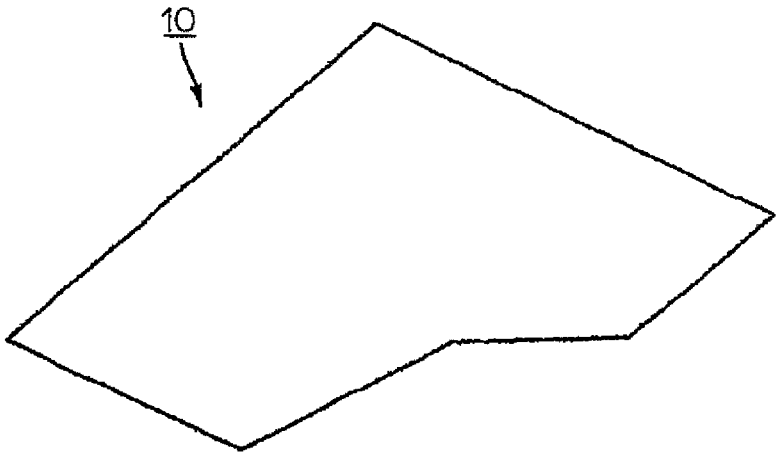
PRIOR ART

[Figure 19]
PRIOR ART
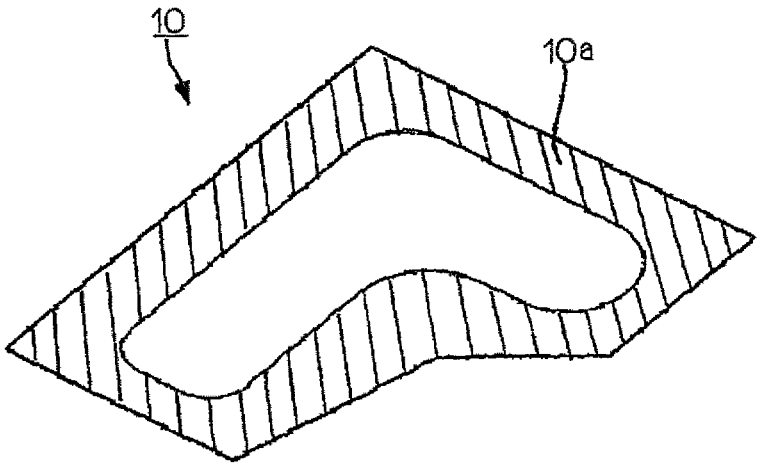
[Figure 20]
PRIOR ART
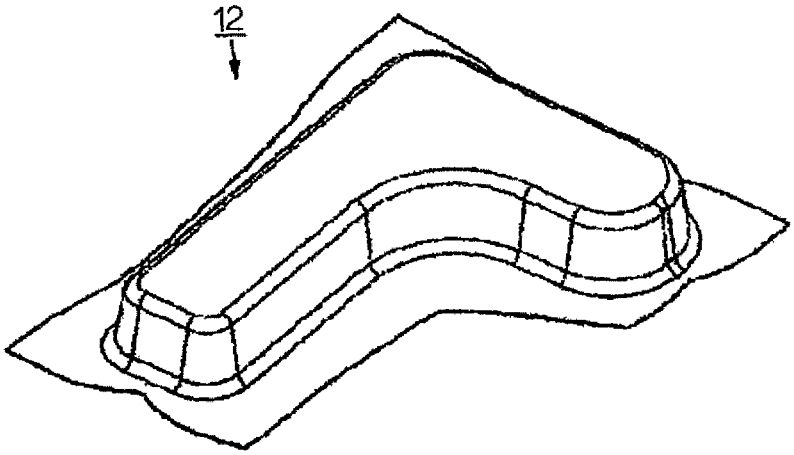

[Figure 21]
PRIOR ART
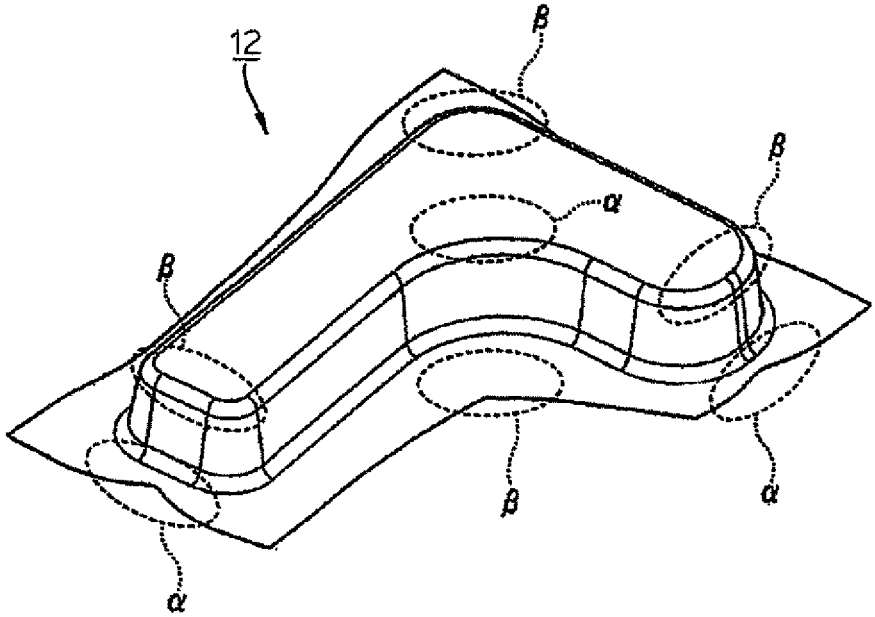

[Figure 22]
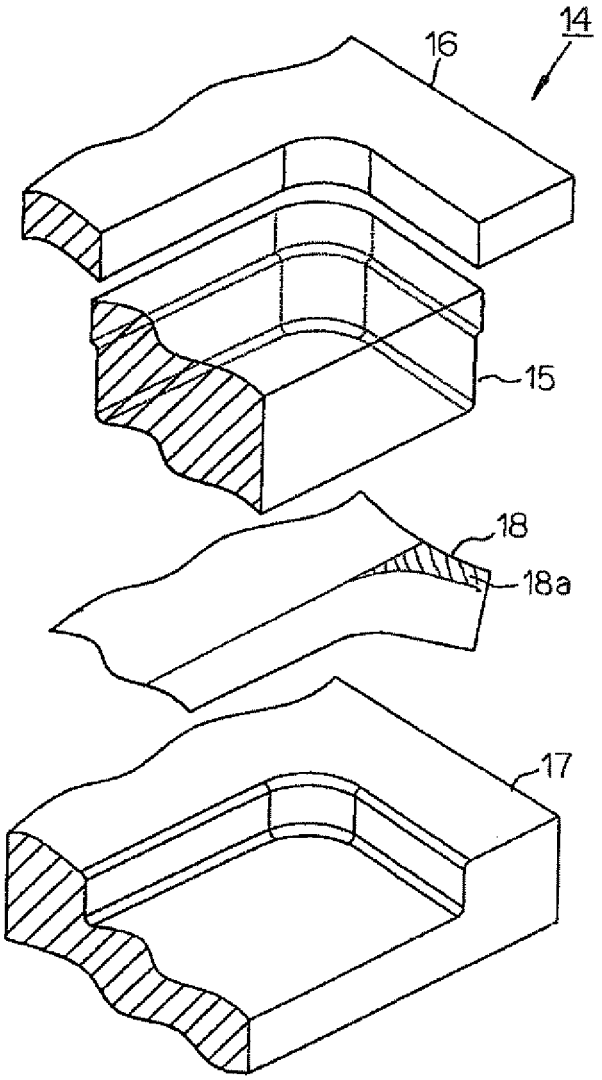
PRIOR ART

METHOD AND APPARATUS FOR MANUFACTURING PRESS COMPONENT

TECHNICAL FIELD

The present invention relates to a method for manufacturing a press component, and an apparatus for manufacturing a press component.

BACKGROUND ART

The body shell of an automobile has a unit construction structure (monocoque structure). A unit construction structure is constituted by a number of framework members and formed panels that are joined together.

For example, a front pillar, a center pillar, a side sill, a roof rail and a side member are known as framework members. Further, for example, a hood ridge, a dash panel, a front floor panel, a rear floor front panel and a rear floor rear panel are known as formed members.

Framework members that have a closed cross-section such as a front pillar, a center pillar and a side sill are assembled by joining configuration members such as a front pillar reinforcement, a center pillar reinforcement and a side sill outer reinforcement to other configuration members such as an outer panel and an inner panel.

FIG. 14 is an explanatory drawing that illustrates an example of a framework member 1.

As illustrated in FIG. 14, a framework member 1 is assembled by joining configuration members 2, 3, 4 and 5 together by spot welding. The configuration member 2 has a substantially hat-shaped cross-sectional shape. The substantially hat-shaped cross-sectional shape includes a top plate 2*a*, a pair of left and right vertical walls 2*b* and 2*b*, and flanges 2*c* and 2*c* that connect with the vertical walls 2*b* and 2*b*. The top plate 2*a* has an inverted L-shaped external shape in plan view as viewed from a direction orthogonal to the top plate 2*a*.

Note that, a configuration member also exists that has an L-shaped external shape that is opposite to the shape of the aforementioned configuration member 2 illustrated in FIG. 14 in plan view. In the following description, a component having the aforementioned L-shaped or inverted L-shaped external shape in plan view is referred to generically as an "L-shaped component". The strength and rigidity of the framework member 1 are secured by having an L-shaped component as a constituent element.

FIG. 15 is an explanatory drawing illustrating an example of a T-shaped component 6. A top plate 6*a* of the T-shaped component 6 has a T-shaped external shape in plan view when viewed from a direction that is orthogonal to the top plate 6*a*. For example, a center pillar reinforcement is known as the T-shaped component 6.

Similarly to the L-shaped component 2, the T-shaped component 6 has a substantially hat-shaped cross-sectional shape. The substantially hat-shaped cross-sectional shape has a top plate 6*a*, a pair of left and right vertical walls 6*b* and 6*b*, and a pair of left and right flanges 6*c* and 6*c*. In addition, a Y-shaped component (refer to FIG. 13 that is described later) is known as a modification of the T-shaped component 6. A top plate 6*a* of the Y-shaped component has an external shape that is a Y-shape in the aforementioned plan view. In the following description, the L-shaped component 2, the T-shaped component 6 and the Y-shaped component are referred to generically as "curved component".

A curved component is usually manufactured by press working by draw forming in order to prevent the occurrence of wrinkling.

FIGS. 16(*a*) and 16(*b*) are explanatory drawings illustrating an outline of press working by draw forming, in which FIG. 16(*a*) illustrates a state prior to the start of forming, and FIG. 16(*b*) illustrates a state when forming is completed (bottom dead center of forming).

As illustrated in FIG. 16(*a*) and FIG. 16(*b*), press working by draw forming is performed on a blank 10 using a die 7, a punch 8 and a blank holder 9 to form an intermediate press component 12.

FIG. 17 is an explanatory drawing illustrating an example of a press component 11 manufactured by press working by draw forming. FIG. 18 is an explanatory drawing illustrating a blank 10 that is the forming starting material for the press component 11. FIG. 19 is an explanatory drawing illustrating a wrinkle suppression region 10*a* of the blank 10. FIG. 20 is an explanatory drawing illustrating an intermediate press component 12 as it is in a state in which press working has been performed thereon.

The press component 11 illustrated in FIG. 17 is manufactured by press working by draw forming through, for example, the processes (i) to (iv) that are listed hereunder.

(i) The blank 10 illustrated in FIG. 18 is disposed between the die 7 and the punch 8.

(ii) The wrinkle suppression region 10*a* (hatched region in FIG. 19) at the periphery of the blank 10 is firmly held by the die 7 and the blank holder 9 as illustrated in FIG. 16(*a*) and FIG. 16(*b*). By this means, excessive inflow of the blank 10 into the press mold is suppressed.

(iii) By moving the die 7 and the punch 8 relatively to each other in a pressing direction (vertical direction) in which the die 7 and the punch 8 approach each other as illustrated in FIG. 16(*b*), press working by draw forming is performed on the blank 10 to form the intermediate press component 12.

(iv) By cutting off (trimming) the wrinkle suppression region 10*a* (a cutting-off region that is an unrequired portion) around the intermediate press component 12, the press component 11 illustrated in FIG. 17 is obtained.

As illustrated in FIGS. 17 to 20, in the press working by draw forming, excessive inflow of the blank 10 into the press mold is suppressed by the blank holder 9. Therefore, the occurrence of wrinkles in the intermediate press component 12 that are caused by excessive inflow of the blank 10 is suppressed.

However, the occurrence of the cutting-off region that is an unrequired portion around the intermediate press component 12 is unavoidable. Consequently, the yield of the press component 11 decreases and the manufacturing cost of the press component 11 rises.

FIG. 21 is an explanatory drawing illustrating an example of the state of occurrence of pressing defects (wrinkling and cracking) in the intermediate press component 12.

As illustrated in FIG. 21, in the intermediate press component 12, wrinkling is liable to occur at a regions where the blank 10 is liable to excessively flow into the press mold during the draw forming process, and cracking is liable to occur at β regions where there is a partial reduction in sheet thickness during the draw forming process.

In particular, when it is attempted to manufacture a curved component by performing pressing working by draw forming on the blank 10 that is made from a high strength steel sheet with low ductility, wrinkling and cracking are liable to occur in the intermediate press component 12 due to insufficient ductility of the blank 10.

To prevent the occurrence of such wrinkling and cracking in the intermediate press component 12, conventionally a steel sheet that has excellent ductility but comparatively low strength has been used as the blank 10 for the curved component. Consequently, to secure the strength required for the curved component, it has been necessary to make the sheet thickness of the blank 10 thick, making an increase in the weight and an increase in the manufacturing cost of the curved component unavoidable.

The present applicants have previously disclosed, in Patent Document 1, a patented invention relating to a method that, even when using a blank made from a high tensile strength steel sheet having low ductility, enables press working of a curved component by bending forming with a good yield, and without wrinkling or cracking occurring. In the present description, the method relating to the aforementioned patented invention is also referred to as "free bending method".

Hereunder, the aforementioned patented invention will be described referring to the aforementioned FIG. 17 and FIG. 22. FIG. 22 is an explanatory drawing that partially illustrates an outline of the patented invention disclosed by Patent Document 1.

The patented invention disclosed by Patent Document 1 manufactures a press component 11 by performing cold or warm press working by bending forming on a blank. As illustrated in FIG. 17, the press component 11 has a cross-sectional shape (for example, a hat-shaped cross-sectional shape) that includes a top plate 11*a*, convex ridge lines 11*b*, 11*b*, vertical walls 11*c*, 11*c*, concave ridge lines 11*d*, 11*d*, and flanges 11*e*, 11*e*.

The top plate 11*a* extends in first direction (direction indicated by an arrow in FIG. 17). The convex ridge lines 11*b*, 11*b* are connected to the two ends in the width direction (direction orthogonal to the first direction) of the top plate 11*a*, respectively. The vertical walls 11*c*, 11*e* are connected to the convex ridge lines 11*b*, 11*b*, respectively. The concave ridge lines 11*d*, 11*d* are connected to the vertical walls 11*c*, 11*c*, respectively. The flanges 11*e*, 11*e* are connected to the concave ridge lines 11*d*, 11*d*, respectively.

The press component 11 also has a curved portion 13 that curves in a plan view that is orthogonal to the top plate 11*a*, and by this means the press component 11 has an external shape that is an inverted L-shape.

According to the free bending method, as illustrated in FIG. 22, a blank 18 is disposed between a die 15 and a die pad 16, and a punch 17 of a press-forming machine 14 that employs bending forming.

By (i) the die pad 16 applying a pressure that is 1.0 MPa or more and less than 32.0 MPa to a portion (vicinity of a portion at which the curved portion 13 of the press component 11 is to be formed) 18*a* of a portion at which the top plate 11*a* is to be formed in the blank 18, or (ii) the die pad 16 being brought adjacent to or into contact with the punch 17 so that the distance of a gap between the die pad 16 and the punch 17 satisfies the condition of being within a range of {sheet thickness of blank 18×(1.0 to 1.1)}, the press component 11 is manufactured by performing press working as described hereunder while suppressing out-of-plane deformation at the portion 18*a* of the portion at which the top plate 11*a* is to be formed.

In a state in which a portion (portion corresponding to the base of the inverted L-shape) of the blank 18 to be formed into an end portion 11*f* in the extending direction of the top plate 11*a* is present on the same plane as a portion of the blank 18 to be formed into the top plate 11*a*, the die 15 and the punch 17 are moved relative to each other in directions in which the die 15 and the punch 17 approach each other.

By this means, while causing the portion (portion corresponding to the base of the inverted L-shape) of the blank 18 to be formed into the end portion 11*f* to move in-plane (slide) over the portion of the die 15 at which top plate 11*a* will be formed, the vertical wall 11*c*, concave ridge line 11*d* and flange 11*e* on the inner circumferential side of the curved portion 13 are formed.

In this way, when manufacturing the press component 11 having the curved portion 13 by performing press working on the blank 18, during the press working, the inflow amount of the portion of the blank 18 to be formed into the end portion 11*f* in the extending direction of the top plate 11*a* that flows into the portion of the blank 18 to be formed into the vertical wall 11*c* increases.

Consequently, according to the free bending method, excessive tensile stress at the flange 11*e* (in the conventional press working by draw forming, a region where cracking is liable to occur due to a reduction in the sheet thickness) on the inner circumferential side of the curved portion 13 is reduced, and the occurrence of cracking is suppressed.

Further, according to the free bending method, at the top plate 11*a* (in the conventional press working by draw forming, a region where wrinkling is liable to occur due to excessive inflow of the blank 18) also, because the blank 18 is pulled, the occurrence of wrinkling is suppressed.

Further, according to the free bending method, a wrinkle suppression region (cutting-off region) that must be provided in the blank 18 when performing the conventional press working by draw forming is not required. Therefore, the yield of the press component 11 improves.

In addition, the free bending method employs press working by bending forming. Therefore, the ductility required for the blank 18 in the free bending method is less than the ductility required for a blank when performing press working by draw forming. Accordingly, it is possible to use a high strength steel sheet with comparatively low ductility as the blank 18, and the sheet thickness of the blank 18 can be set to a small thickness, and thus a reduction in the weight of a vehicle can be achieved.

In Patent Document 2, the present applicants disclosed an invention in which an excess portion of a specific shape is provided at an edge section of a portion to be formed into the flange 11*e* on the inner circumferential side of the curved portion 13 in a developed blank that is used in the free bending method.

According to the invention disclosed by Patent Document 2, while further enhancing the formability of the vicinity of the curved portion 13 and preventing cracking of the flange 11*e* on the inner circumferential side of the curved portion 13 by means of the free bending method, excessive inflow of the blank 18 from a portion of the blank 18 to be formed into the top plate 11*a* to a portion of the blank 18 to be formed into the vertical wall 11*c* can also be suppressed, and cracking in the end portion of the top plate 11*a* can also be prevented.

LIST OF PRIOR ART DOCUMENTS

Patent Document

Patent Document 1: WO 2011/145679
Patent Document 2: WO 2014/185428

SUMMARY OF INVENTION

Technical Problem

The present inventors conducted intensive studies to further enhance the formability of the free bending method, and as a result newly found that even when press working is performed on the blank 18 by the free bending methods disclosed in Patent Documents 1 and 2, in some cases the press component 11 cannot be manufactured without defective forming occurring.

As such cases, for example, the following first case and second case may be mentioned. That is, the first case is a case that satisfies at least one of the following conditions:

(a) the blank 18 is made from an ultra-high tensile strength steel sheet having a tensile strength of 1180 MPa or more, (b) a height (projection distance in a product height direction of the vertical wall 11*c*) of the press component 11 is a high height of 70 mm or more, (c) a radius of curvature $R_1$ of the concave ridge line 11*d* of the press component 11 is a small value of 10 mm or less in side view, and (d) a radius of curvature $R_2$ of the curved portion 13 of the press component 11 is a small value of 100 mm or less in plan view;

and the second case is a case that satisfies at least two or more of the following conditions:

(e) the blank 18 is made from an ultra-high tensile strength steel sheet having a tensile strength of 1180 MPa or more, (f) the height (projection distance in the product height direction of the vertical wall 11*c*) of the press component 11 is 55 mm or more, (g) the radius of curvature $R_1$ of the concave ridge line 11*d* of the press component 11 is 15 mm or less in side view, and (h) the radius of curvature $R_2$ on the inner side of the curved portion 13 of the press component 11 is 140 mm or less in plan view.

In the first case or second case, even if the free bending method is used, cracking occurs in the flange 11*e* on the inner circumferential side of the curved portion 13.

The present invention has been conceived to solve these new problems of the inventions disclosed in Patent Documents 1 and 2. An objective of the present invention is to provide a manufacturing method and a manufacturing apparatus for manufacturing a press component, which can manufacture a curved component without generating cracking in a flange on an inner circumferential side of the curved portion even when press working by the free bending method is performed on a blank in the aforementioned first case or second case.

Solution to Problem

The present inventors conducted intensive studies to solve the above described problem, and as a result obtained the findings A to D described hereunder to thereby complete the present invention.

(A) As has been described referring to FIG. 17 and FIG. 22, in the free bending method, a portion (portion corresponding to the base of the inverted L-shape) of the blank 18 to be formed into the end portion 11*f* in the extending direction of the top plate 11*a* flows in towards a portion of the blank 18 to be formed into the vertical wall 11*c* on the inner circumferential side of the curved portion 13. By this means, in the blank 18, material is supplied to a portion to be formed into the flange 11*e* on the inner circumferential side of the curved portion 13.

Therefore, by increasing the amount by which the portion of the blank 18 to be formed into the end portion 11*f* in the extending direction of the top plate 11*a* flows into the portion of the blank 18 to be formed into the vertical wall 11*c* on the inner circumferential side of the curved portion 13, the occurrence of cracking in the flange 11*e* on the inner circumferential side of the curved portion 13 can be prevented, and it is thus possible to raise the forming limit of the free bending method.

(B) However, when performing press working, a limit of the aforementioned inflow amount is geometrically determined according to the amount of change in a cross-section line length of the flange 11*e* between before and after forming of a cross-section in the inflow direction. Further, the limit of the inflow amount serves as the forming limit in the free bending method.

(C) When performing press-forming, the aforementioned inflow amount can be increased by, for example, forming, at the same time as the press-forming, a material inflow facilitating portion such as a bead in the vicinity (preferably, in the blank 18, a region that is outside a region to be formed into the press component 11) of a portion of the blank 18 to be formed into the flange 11*e* on the inner circumferential side of the curved portion 13.

(D) By making the shape of the material inflow facilitating portion a shape that can secure a cross-section line length difference in an inflow direction of the material (in the blank 18, the maximum principal strain direction of a deformation of a portion to be formed into the flange 11*e* on the inner circumferential side of the curved portion 13), the aforementioned inflow amount can be increased, and by this means the forming limit in the free bending method can be raised.

The present invention is as described hereunder.

(1) A method for manufacturing a press component, by performing press working on a blank or a pre-formed blank disposed between a die and a die pad, and a punch that is disposed facing the die and die pad, which constitute a press-forming apparatus that employs bending forming, the press component having a cross-sectional shape constituted by a top plate extending in a first direction, a convex ridge line connecting to an end portion of the top plate in a direction orthogonal to the first direction, a vertical wall connecting to the convex ridge line, a concave ridge line connecting to the vertical wall, and a flange connecting to the concave ridge line, and also having a curved portion that, with the convex ridge line, the vertical wall and the concave ridge line curving, provides an external shape of the top plate with an L-shape, a T-shape or a Y-shape in a plan view that is orthogonal to the top plate, the method comprising, when manufacturing the press component:

weakly pressing a portion of the blank to be formed into a part of the top plate of the curved portion by the die pad, or subjecting the die pad to approach or come in contact with a portion of the blank to be formed into a part of the top plate of the curved portion while maintaining a gap between the die pad and the punch at a distance that is not less than a sheet thickness of the blank and not more than 1.1 times the sheet thickness of the blank, and forming, in a state in which a portion of the blank to be formed into an end portion of the top plate in the first direction is present on a same plane as the portion of the blank to be formed into the top plate, the vertical wall, the concave ridge line and the flange on an inner circumferential side of the curved portion while causing the portion of the blank that is to be formed into the end portion of the top plate in the first direction to move in-plane over a portion of the die at which the top plate will be formed by relatively moving the die and the punch in directions in which the die and the punch approach each other, wherein, by the press working, in a vicinity of a portion of the blank to be formed into a flange on the inner circumferential side of the curved portion of the press component, one or more material inflow facilitating portions are provided, the material inflow facilitating portions increasing an inflow amount by which the portion of the blank to be formed into the end portion flows into the portion of the blank to be formed into the flange on the inner circumferential side of the curved portion, and the material inflow facilitating portion includes, in a plan view orthogonal to the top plate, a cross-sectional shape in which a cross-section line length in a cross-section parallel to a straight line that is tangent to a middle position of an inner circumference of the curved portion increases with distance from the flange on the inner circumferential side of the curved portion.

(2) The method for manufacturing a press component described in item (1) above, wherein the method satisfies at least one of the following conditions:

the blank comprises an ultra-high tensile strength steel sheet having a tensile strength of 1180 MPa or more;

a projection distance of the vertical wall in a product height direction as a height of the press component is 70 mm or more;

a radius of curvature of the concave ridge line of the press component is 10 mm or less in side view; and a radius of curvature on the inner circumferential side of the curved portion in the press component is 100 mm or less in the plan view.

(3) The method for manufacturing a press component described in item (1) above, wherein the method satisfies two or more of the following conditions:

the blank comprises an ultra-high tensile strength steel sheet having a tensile strength of 1180 MPa or more;

a projection distance of the vertical wall in a product height direction as a height of the press component is 55 mm or more;

a radius of curvature of the concave ridge line of the press component is 15 mm or less in side view, and a radius of curvature on an inner side of the curved portion in the press component is 140 mm or less in the plan view.

(4) The method for manufacturing a press component described in any one of items (1) to (3) above, wherein:

in the blank, the material inflow facilitating portion is provided at a region that is outside of a region to be formed into the press component.

(5) The method for manufacturing a press component described in any one of items (1) to (4) above, wherein:

the cross-sectional shape includes a case where the cross-section line length is partially constant.

(6) The method for manufacturing a press component described in any one of items (1) to (5) above, wherein:

the material inflow facilitating portion is a convex bead that is convex toward a same side as the top plate of the press component, or is a concave bead that is convex toward an opposite side to the top plate of the press component.

(7) The method for manufacturing a press component described in any one of items (1) to (6) above, wherein:

the material inflow facilitating portion is provided at least in a region in which the blank is present.

(8) The method for manufacturing a press component described in any one of items (1) to (7) above, wherein:

the material inflow facilitating portion is provided in a stepped shape in a direction parallel to a sheet thickness direction of the blank.

(9) The method for manufacturing a press component described in any one of items (1) to (8) above, wherein:

the material inflow facilitating portion has an external shape obtained by connecting a meeting point of the concave ridge line and the flange in the curved portion that is formed, and an end portion of the blank at a time when the forming starts.

(10) The method for manufacturing a press component described in any one of items (1) to (9) above, wherein:

the cross-sectional shape is a hat-shaped cross-sectional shape constituted by:

a top plate extending in a first direction, two convex ridge lines connecting to both end portions of the top plate in a direction orthogonal to the first direction, two vertical walls connecting to the two convex ridge lines, respectively, two concave ridge lines connecting to the two vertical walls, respectively, and two flanges connecting to the two concave ridge lines, respectively.

(11) An apparatus for manufacturing a press component, that comprises a die and a die pad, and a punch that is disposed facing the die and die pad, and that:

by performing press working on a blank or a pre-formed blank that is disposed between the die and die pad and the punch, manufactures a press component having a cross-sectional shape constituted by a top plate extending in a first direction, a convex ridge line connecting to an end portion in a direction orthogonal to the first direction of the top plate, a vertical wall connecting to the convex ridge line, a concave ridge line connecting to the vertical wall, and a flange connecting to the concave ridge line, and also having a curved portion that, with the convex ridge line, the vertical wall and the concave ridge line curving, provides an external shape of the top plate with an L-shape, T-shape or Y-shape in a plan view that is orthogonal to the top plate, the apparatus manufacturing the press component by:

the die pad weakly pressing a portion of the blank to be formed into a part of the top plate of the curved portion, or the die pad approaching or contacting with a portion of the blank to be formed into a part of the top plate of the curved portion while maintaining a gap between the die pad and the punch at a distance that is not less than a sheet thickness of the blank and not more than 1.1 times the sheet thickness of the blank, and in a state in which a portion of the blank to be formed into an end portion in the first direction of the top plate is present on a same plane as the portion of the blank to be formed into the top plate, by the die and the punch moving relatively in directions in which the die and the punch approach each other, forming the vertical wall, the concave ridge line and the flange on an inner circumferential side of the curved portion while causing the portion of the blank to be formed into the end portion to move in-plane over a portion of the die at which the top plate will be formed;

wherein:

the die and the punch comprise a material inflow facilitating portion forming mechanism that, by means of the press working, in a vicinity of a portion of the blank to be formed into a flange on an inner circumferential side of the curved portion of the press component, provides one or more material inflow facilitating portions that increase an amount by which a portion of the blank to be formed into the end portion flows into the portion of the blank to be formed into the flange on the inner circumferential side of the curved portion; and the material inflow facilitating portion forming mechanism provides the material inflow facilitating portion in a manner so that, in a plan view that is orthogonal to the top plate, a cross-section line length of the material inflow facilitating portion at a cross-section that is parallel to a straight line that is tangent to a center position of an inner circumference of the curved portion increases with distance from the flange on the inner circumferential side of the curved portion.

(12) The apparatus for manufacturing a press component described in item (11) above, the apparatus for manufacturing a press component according to claim 11, wherein the apparatus satisfies at least one of the following conditions:

the blank comprises an ultra-high tensile strength steel sheet having a tensile strength of 1180 MPa or more;

a projection distance of the vertical wall in a product height direction as a height of the press component is 70 mm or more;

a radius of curvature of the concave ridge line of the press component is 10 mm or less in side view; and a radius of curvature on the inner circumferential side of the curved portion in the press component is 100 mm or less in the plan view.

(13) The apparatus for manufacturing a press component described in item (11) above, wherein the apparatus satisfies two or more of the following conditions:

the blank comprises an ultra-high tensile strength steel sheet having a tensile strength of 1180 MPa or more;

a projection distance of the vertical wall in a product height direction as a height of the press component is 55 mm or more;

a radius of curvature of the concave ridge line of the press component is 15 mm or less in side view, and a radius of curvature on an inner side of the curved portion in the press component is 140 mm or less in the plan view.

(14) The apparatus for manufacturing a press component described in any one of items (11) to (13) above, wherein:

the material inflow facilitating portion forming mechanism provides the material inflow facilitating portion at a region of the blank that is outside of a region to be formed into the press component.

(15) The apparatus for manufacturing a press component described in any one of items (11) to (14) above, wherein:

the cross-sectional shape includes a case where the cross-section line length is partially constant.

(16) The apparatus for manufacturing a press component described in any one of items (11) to (15) above, wherein:

the material inflow facilitating portion is a convex bead that is convex toward a same side as the top plate of the press component, or is a concave bead that is convex toward an opposite side to the top plate of the press component.

(17) The apparatus for manufacturing a press component described in any one of items (11) to (16) above, wherein:

the material inflow facilitating portion forming mechanism provides the material inflow facilitating portion in at least a region in which the blank is present.

(18) The apparatus for manufacturing a press component described in any one of items (11) to (17) above, wherein:

the material inflow facilitating portion forming mechanism provides the material inflow facilitating portion in a stepped shape in a direction parallel to a sheet thickness direction of the blank.

(19) The apparatus for manufacturing a press component described in any one of items (11) to (18) above, wherein:

the material inflow facilitating portion forming mechanism provides the material inflow facilitating portion so as to have an external shape obtained by connecting a region of the blank to be formed into a meeting point between the concave ridge line and the flange of the curved portion, and an end portion of the blank prior to the forming.

(20) The apparatus for manufacturing a press component described in any one of items (11) to (19) above, wherein:

the cross-sectional shape is a hat-shaped cross-sectional shape constituted by:

a top plate extending in a first direction, two convex ridge lines connecting to both end portions of the top plate in a direction orthogonal to the first direction, two vertical walls connecting to the two convex ridge lines, respectively, two concave ridge lines connecting to the two vertical walls, respectively, and two flanges connecting to the two concave ridge lines, respectively.

Advantageous Effects of Invention

According to the present invention, even when press working by a free bending method is performed on a blank in the aforementioned first case or second case, an inflow amount of material can be increased and a forming limit can be raised in comparison to the free bending methods disclosed by Patent Documents 1 and 2, and it is thus possible to manufacture a press component without generating cracking in a flange on an inner circumferential side of a curved portion of a press component.

BRIEF DESCRIPTION OF DRAWINGS

FIG. 1 is an explanatory drawing illustrating a configuration example of a manufacturing apparatus according to the present invention.

FIG. 2 is an explanatory drawing partially illustrating an example of a press component that was press-formed by the manufacturing apparatus according to the present invention.

FIG. 3 is an explanatory drawing illustrating the positional relationship between a material inflow facilitating portion forming mechanism and a concave ridge line forming portion of the manufacturing apparatus according to the present invention and a blank.

FIG. 4 is an explanatory drawing illustrating a cross-section in a conventional punch in which a material inflow facilitating portion forming mechanism is not provided, that corresponds to a cross-section A-A in FIG. 1.

FIG. 5 is an explanatory drawing illustrating the positional relationship between a material inflow facilitating portion forming mechanism and a concave ridge line forming portion of the manufacturing apparatus according to the present invention and a blank, and the locations of cross-sections B, C and D.

FIG. 6 is a graph illustrating cross-section line length differences with respect to a conventional punch at a flange forming portion of a punch at the cross-sections B, C and D.

FIG. 7 is an explanatory drawing illustrating a cross-section A-A of a punch in which a material inflow facilitating portion forming mechanism is provided.

FIG. 8 is an explanatory drawing illustrating the positional relationship between a material inflow facilitating portion forming mechanism and a concave ridge line forming portion of the manufacturing apparatus according to the present invention and a blank, and the locations of cross-sections B, C and D.

FIG. 9 is an explanatory drawing that shows the reason why cracking at a portion "a" of a blank is prevented by providing a material inflow facilitating portion forming mechanism constituted by a recess and a protrusion in a die and punch.

FIG. 12 is an explanatory drawing illustrating an intermediate component (example embodiment of the present invention) for a T-shaped component.

FIG. 13 is an explanatory drawing illustrating an intermediate component (example embodiment of the present invention) for a Y-shaped component.

FIG. 14 is an explanatory drawing illustrating an example of a framework member.

FIG. 15 is an explanatory drawing illustrating an example of a T-shaped component.

FIG. 16(*a*) and FIG. 16(*b*) are explanatory drawings illustrating an outline of press working by draw forming, in which FIG. 16(*a*) illustrates a state prior to the start of forming, and FIG. 16(*b*) illustrates a state when forming is completed (bottom dead center of forming).

FIG. 17 is an explanatory drawing illustrating an example of a press component manufactured by press working by draw forming.

FIG. 18 is an explanatory drawing illustrating a blank that is a forming starting material for a press component.

FIG. 19 is an explanatory drawing illustrating a wrinkle suppression region of a blank.

FIG. 20 is an explanatory drawing illustrating an intermediate press component as it is in a state in which press working has been performed thereon.

FIG. 21 is an explanatory drawing illustrating an example of the state of occurrence of pressing defects in an intermediate press component.

FIG. 22 is an explanatory drawing that partially illustrates an outline of the patented invention disclosed by Patent Document 1.

DESCRIPTION OF EMBODIMENTS

Figures 10A, 10B, 10C, 10D, 10E, 10F:
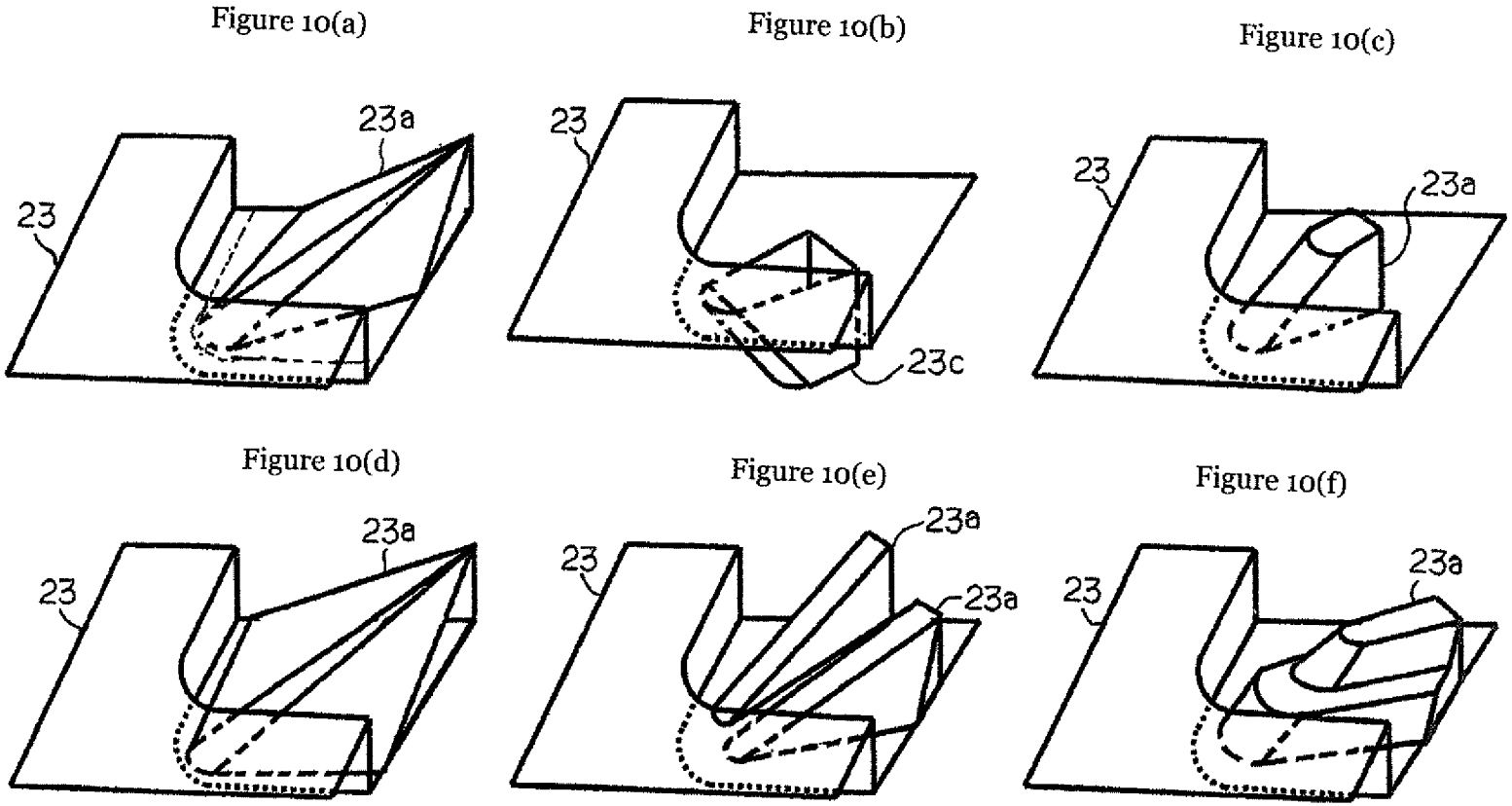
FIG. 10(*a*) to FIG. 10(*f*) are explanatory drawings that partially illustrate examples of the shapes of protrusions or recesses that are constituent elements of various kinds of material inflow facilitating portion forming mechanisms that are provided in a punch.

The manufacturing apparatus and manufacturing method according to the present invention are described hereunder.

In the following description, a case in which a press component 11 to be manufactured by the present invention is an L-shaped component in which a top plate 11*a* has an external shape that is an inverted L-shape in a plan view that is orthogonal to the top plate 11*a* is taken an example. However, objects to be manufactured by the present invention are not limited to an L-shaped component, and also include other curved components (T-shaped component and Y-shaped component).

Further, in the following description, a case in which the press component 11 and an intermediate component 11-1 have a hat-shaped cross-sectional shape constituted by the top plate 11*a*, two convex ridge lines 11*b*, 11*b*, two vertical walls 11*c*, 11*c*, two concave ridge lines 11*d*, 11*d* and two flanges 11*e*, 11*e* is taken as an example. However, objects to be manufactured by the present invention are not limited to the press component 11 and the intermediate component 11-1 that have a hat-shaped cross-sectional shape, and also include intermediate components 11-2 and 11-3 for press components having the cross-sectional shapes shown in FIG. 11 set forth below.

1. Manufacturing Apparatus 20 of the Present Invention

FIG. 1 is an explanatory drawing illustrating a configuration example of a manufacturing apparatus 20 according to the present invention. FIG. 2 is an explanatory drawing partially illustrating an example of an intermediate component 11-1 of a press component 11 that was press-formed by the manufacturing apparatus 20.

As illustrated in FIG. 1, the manufacturing apparatus 20 is a press-forming apparatus that employs bending forming and that uses the free bending method.

The manufacturing apparatus 20 includes a die 21, a die pad 22 and a punch 23. The punch 23 is disposed facing the die 21 and the die pad 22. The die pad 22 is movable up and down together with the die 21, and can also press a part of a blank 24.

The manufacturing apparatus 20 manufactures the intermediate component 11-1 of the press component 11 having the external shape illustrated in FIG. 2 by performing press working as cold or warm working on the blank (developed blank) 24 or on a blank (not illustrated in the drawings) which was subjected to preforming that is minor processing (for example, embossing) that is disposed between the die 21 and die pad 22 and the punch 23.

The sheet thickness of the blank 24 is preferably 0.6 to 2.8 mm, more preferably 0.8 to 2.8 mm, and further preferably 1.0 to 2.8 mm.

The press component 11 or the intermediate component 11-1 has a hat-shaped cross-sectional shape. The hat-shaped cross-sectional shape is a shape that includes a top plate 11*a*, two convex ridge lines 11*b*, 11*b*, two vertical walls 11*c*, 11*c*, two concave ridge lines 11*d*, 11*d*, and two flanges 11*e*, 11*e*.

The press component 11 or the intermediate component 11-1 thereof has a curved portion 13. The curved portion 13 curves so that the external shape of the top plate 11*a* in a plan view orthogonal to the top plate 11*a* is an inverted L-shaped.

The top plate 11*a* extends in a first direction (arrow direction in FIGS. 2 and 17). The two convex ridge lines 11*b*, 11*b* connect to both end portions in a direction which is orthogonal (that is, the width direction of the top plate 11*a*) to the first direction of the top plate 11*a*. The two vertical walls 11*c*, 11*c* connect to the two convex ridge lines 11*b*, 11*b*, respectively. The two concave ridge lines 11*d*, 11*d* connect to the two vertical walls 11*c*, 11*c*, respectively. The two flanges 11*e*, 11*e* connect to the two concave ridge lines 11*d*, 11*d*, respectively.

The manufacturing apparatus 20 is favorably used in the following first case and second case.

First case: A case satisfying one or more conditions among a condition that the blank 24 is made from an ultra-high tensile strength steel sheet having a tensile strength of 1180 MPa or more, a condition that a projection distance in a product height direction of the vertical wall 11*c* as a height of the press component 11 or the intermediate component 11-1 thereof is 70 mm or more, a condition that a radius of curvature $R_1$ of the concave ridge line 11*d* of the press component 11 or the intermediate component 11-1 thereof is 10 mm or less in side view, and a condition that a radius of curvature $R_2$ on an inner circumferential side of the curved portion 13 of the press component 11 or the intermediate component 11-1 thereof is 100 mm or less in plan view.

Second case: A case satisfying at least two conditions among a condition that the blank 24 is made from an ultra-high tensile strength steel sheet having a tensile strength of 1180 MPa or more, a condition that a height (projection distance in a product height direction of the vertical wall 11*c*) of the press component 11 or the intermediate component 11-1 thereof is 55 mm or more, a condition that a radius of curvature $R_1$ of the concave ridge line 11*d* of the press component 11 or the intermediate component 11-1 thereof is 15 mm or less in side view, and a condition that a radius of curvature $R_2$ on an inner side of the curved portion 13 of the press component 11 or the intermediate component 11-1 thereof is 140 mm or less in plan view.

This is because, if press working by the conventional free bending method is performed on the blank 24 in the first case or the second case, cracks will be generated in the flange 11*e* on the inner circumferential side of the curved portion 13 of the obtained press component 11 or intermediate component 11-1 thereof, and therefore the significance of using the manufacturing apparatus 20 will be recognized.

The die pad 22 presses a portion of the blank 24 to be formed into a part of the top plate 11*a* at the curved portion 13 of the press component 11 with an applied pressure that is 1.0 MPa or more and less than 32.0 MPa, or comes adjacent to or into contact with the aforementioned portion of the blank 24 while maintaining the distance of a gap with respect to the punch 23 at a distance corresponding to 1.0 to 1.1 times the sheet thickness of the blank 24.

By this means, while out-of-plane deformation at the aforementioned portion of the blank 24 is being suppressed by the die pad 22, the intermediate component 11-1 of the press component 11 is manufactured by performing press working that is described hereunder.

That is, in the press working, in a state in which a portion of the blank 24 to be formed into the end portion 11*f* in the first direction of the top plate 11*a* is present on the same plane as a portion of the blank 24 to be formed into the top plate 11*a*, the die 21 and the punch 23 are relatively moved in directions in which the die 21 and the punch 23 approach each other.

By this means, the vertical wall 11*c*, the concave ridge line 11*d* and the flange 11*e* on the inner circumferential side of the curved portion 13 are formed while the portion of the blank 24 to be formed into the end portion 11*f* is caused to move in-plane (slide) over a portion of the die 21 at which the top plate 11*a* will be formed.

In this way, the intermediate component 11-1 of the press component 11 is manufactured.

FIG. 3 is an explanatory drawing illustrating the positional relationship between a material inflow facilitating portion forming mechanism 25 and a concave ridge line forming portion 23*b* of the manufacturing apparatus 20, and the blank 24.

In addition to performing press working by bending forming using the free bending method disclosed by Patent Documents 1 and 2 and the like, in the manufacturing apparatus 20, as illustrated in FIGS. 1 and 3, a recess 21*a* and a protrusion 23*a* as the material inflow facilitating portion forming mechanism 25 for providing a material inflow facilitating portion 19 in the blank 24 are provided in the die 21 and the punch 23, respectively, of the manufacturing apparatus 20. The material inflow facilitating portion forming mechanism 25 is constituted by the recess 21*a* that is provided in the die 21 and the protrusion 23*a* that is provided in the punch 23.

At the time of performing the press working, as illustrated in FIG. 2, the manufacturing apparatus 20 uses the material inflow facilitating portion forming mechanism 25 to provide the material inflow facilitating portion 19 in the vicinity (for example, at only the flange, or at the flange and the concave ridge line) of a portion of the blank 24 to be formed into the flange 11*e* on the inner circumferential side of the curved portion 13 of the intermediate component 11-1.

As illustrated in FIGS. 2 and 3, preferably the material inflow facilitating portion forming mechanism 25 provides the material inflow facilitating portion 19 in a region that is outside a region (hatched region in FIG. 3) of the blank 24 to be formed into the press component 11. By this means, by cutting off the outer edge of the flange 11*e* of the intermediate component 11-1 as a trim line, it is possible not to leave a trace of the material inflow facilitating portion 19 in the press component 11.

In a case where it is acceptable for a trace of the material inflow facilitating portion 19 to remain in the press component 11, the material inflow facilitating portion 19 may be provided in a region of the blank 24 (hatched region in FIG. 3) to be formed into the press component 11.

Next, the material inflow facilitating portion forming mechanism 25 will be described in more detail.

FIG. 4 is an explanatory drawing illustrating a cross-section in a conventional punch 23-1 in which the material inflow facilitating portion forming mechanism 25 is not provided, that corresponds to a cross-section A-A in FIG. 1.

FIG. 5 is an explanatory drawing illustrating the positional relationship between the blank 24 and the material inflow facilitating portion forming mechanism 25 and concave ridge line forming portion 23*b* of the manufacturing apparatus 20, and locations of cross-sections B, C and D.

FIG. 6 is a graph illustrating cross-section line length differences (inflow amounts) with respect to a conventional punch at a flange forming portion of the punch 23 at the cross-sections B, C and D. In the cross-sections B, C and D in the graph in FIG. 6, the left side illustrates a case according to the conventional method, and the right side illustrates a case according to the method of the present invention. Further, the cross-sections below the graph in FIG. 6 illustrate the respective shapes of the blank 24 at the cross-sections B, C and D.

FIG. 7 is an explanatory drawing illustrating a cross-section A-A of the punch 23 in which the material inflow facilitating portion forming mechanism 25 is provided.

In the aforementioned first case or second case, if press working of the blank 24 is performed by the free bending method using the conventional punch 23-1, cracking will occur at a portion "a" shown in FIG. 4.

As illustrated in FIGS. 5 and 6, according to the present invention, by providing the material inflow facilitating portion forming mechanism 25 that is constituted by the recess 21*a* and the protrusion 23*a*, the material inflow facilitating portion 19 is provided in the intermediate component 11-1 by press working.

The cross-sections B, C and D in FIGS. 5 and 6 are cross-sections in a material inflow direction that is parallel to a straight line that is tangent to a center position (portion "a") of an inner circumference of the curved portion 13 in a plan view orthogonal to the top plate 11*a*. The cross-sections B, C and D are cross-sections in a maximum principal strain direction of a deformation of a portion to be formed into the flange 11*e* on the inner circumferential side of the curved portion 13.

The material inflow facilitating portion 19 is provided so that cross-section line lengths at the cross-sections B, C and D gradually increase with distance from the flange 11*e* on the inner circumferential side of the curved portion 13.

The cross-sectional shape of the material inflow facilitating portion 19 is not limited to a shape which monotonously increases with distance from the flange 11*e* on the inner circumferential side of the curved portion 13 of the intermediate component 11-1, and may be a shape that partially includes a portion at which the cross-section line length is constant.

That is, as illustrated in FIG. 6, in comparison to the conventional method in which the material inflow facilitating portion forming mechanism 25 is not provided, the material inflow facilitating portion forming mechanism 25 of the method of the present invention is provided so that a cross-section line length difference (inflow amount) relative to the conventional punch of the flange forming portion of the punch 23 increases at each of the cross-sections B, C and D, and so that the cross-section line length difference (inflow amount) at the cross-section C increases more than the cross-section line length difference (inflow amount) at the cross-section 13, and the cross-section line length difference (inflow amount) at the cross-section D increases more than the cross-section line length difference (inflow amount) at the cross-section C.

In other words, in the present invention, the material inflow facilitating portion forming mechanism 25 having a shape that increases the cross-section line length difference (inflow amount) at each of the cross-sections B, C and D is provided in the die 21 as the recess 21*a* and is also provided in the punch 23 as the protrusion 23*a*.

For example, as illustrated in FIG. 7, the material inflow facilitating portion 19 is exemplified as being provided as a protrusion having an external shape that is obtained by connecting the meeting point of the concave ridge line 11*d* and the flange 11*e* of the curved portion 13 that is formed, and an end portion 24*a* of the blank 24 at the time that forming starts.

FIG. 8 is an explanatory drawing illustrating the positional relationship between the blank 24 and the material inflow facilitating portion forming mechanism 25 and concave ridge line forming portion 23*b* of the manufacturing apparatus 20, and the locations of cross-sections B, C and D.

As described above, a change differential in the inflow amount of the material that is caused by the material inflow facilitating portion forming mechanism 25 increases with distance from the portion "a" of the blank 24 through the cross-section B, the cross-section C and furthermore the cross-section D as indicated by a broad arrow in FIG. 8.

Note that, cracking at the portion "a" of the blank 24 shown in FIG. 4 occurs when a tensile force in the circumferential direction that is not less than the rupture-yield strength of the blank 24 locally arises. Therefore, if a change in the cross-section line length difference is imparted to the portion "a", cracking at the portion "a" will be more liable to occur. Accordingly, practically no change may be provided in the cross-section line length difference at the portion "a". Further, it is sufficient to set a region that provides a change in the cross-section line length difference (inflow amount) as a region up to the position at which the blank 24 is present before forming, that is, up to the end portion 24*a* illustrated in FIG. 7.

Next, the function of the material inflow facilitating portion forming mechanism 25 will be described.

FIG. 9 is an explanatory drawing that shows the reason why cracking at the portion "a" of the blank 24 is prevented by providing the material inflow facilitating portion forming mechanism 25 that is constituted by the recess 21*a* and the protrusion 23*a*, in the die 21 and the punch 23.

Cracking at the portion "a" of the blank 24 is attributable to a high tensile force F in the circumferential direction of the concave ridge line 11*d* that is located at an upper part of the portion "a" in the blank 24. In the present invention, by providing the material inflow facilitating portion forming mechanism 25 in the die 21 and the punch 23 and performing press working, the inflow amount of the blank 24 to an outer side relative to the portion "a" is increased.

By this means, because the inflow amount of the blank 24 increases from around the portion "a", the inflow amount of the blank 24 to the portion "a" increases. That is, the inflow amount of the blank 24 to the portion of the blank 24 to be formed into the curved portion 13 is increased by means of the material inflow facilitating portion forming mechanism 25. Although the direction of principal strain of a deformation in the portion of the blank 24 to be formed into curved portion 13 does not change significantly, the amount of deformation thereof is reduced.

Thus, according to the present invention, as illustrated by arrows in FIG. 9, the inflow amount of the blank 24 to a portion of the blank 24 to be formed into the flange 11*e* on the inner circumferential side of the curved portion 13 of the press component 11 increases in comparison to the conventional method in which the material inflow facilitating portion forming mechanism 25 is not provided.

By this means, in the blank 24, since the tensile force F in the circumferential direction of the concave ridge line 11*d* that is located at the upper part of the portion "a" can be reduced and the deformation load at the portion of the blank 24 to be formed into the curved portion 13 can be decreased, cracking is prevented at the portion "a" of the blank 24.

FIG. 10(*a*) to FIG. 10(*f*) are explanatory drawings that partially illustrate examples of the shape of the protrusion 23*a* or a recess 23*c* that are constituent elements of various kinds of the material inflow facilitating portion forming mechanism 25 that is provided in the punch 23.

As illustrated in FIG. 10(*a*), a protrusion that is convex toward the same side as the top plate 11*a* of the press component 11 that was described above referring to FIG. 7 can be used as the protrusion 23*a* that is a constituent element of the material inflow facilitating portion forming mechanism 25 provided in the punch 23.

As illustrated in FIG. 10(*b*), the recess 23*c* that is convex toward the opposite side to the top plate 11*a* of the press component 11 may be used instead of the protrusion 23*a* illustrated in FIG. 10(*a*). In this case, it need scarcely be said that a protrusion corresponding to the recess 23*c* is provided in the die 21.

As illustrated in FIG. 10(*c*), in a case where the blank 24 is small, the protrusion 23*a* may be provided in a region which is in contact with the blank 24.

As described in the foregoing and as is also illustrated in FIG. 10(*d*), in a case where it is acceptable for a trace of the material inflow facilitating portion 19 to remain in the press component 11, the protrusion 23*a* as the material inflow facilitating portion 19 may be provided so as to extend over a region (hatched region in FIG. 3) of the blank 24 to be formed into the press component 11.

As illustrated in FIG. 10(*e*), two or more of the protrusions 23*a* that are independent may be provided as constituent elements of the material inflow facilitating portion forming mechanism 25.

In addition, as illustrated in FIG. 10(*f*), the protrusion 23*a* may be provided in a stepped shape in a direction parallel to the sheet thickness direction of the blank 12.

Thus, the material inflow facilitating portion forming mechanism 25 provides one or more of the material inflow facilitating portions 19 that increase an inflow amount by which a portion of the blank 24 to be formed into the end portion 11*f* of the intermediate component 11-1 flows into a portion of the blank 24 to be formed into the flange 11*e* on the inner circumferential side of the curved portion 13 of the intermediate component 11-1.

Figure 11A:
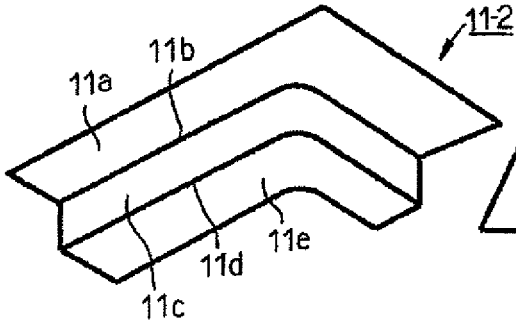
FIG. 11(*a*) and FIG. 11(*b*) are explanatory drawings that respectively illustrate another press component manufactured by the present invention.
Figure 11B:
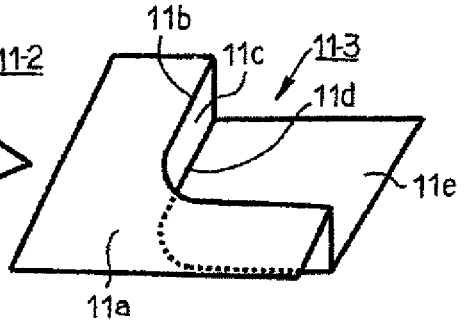

FIG. 11(*a*) and FIG. 11(*b*) are explanatory drawings that respectively illustrate intermediate components 11-2 and 11-3 of other press components to be manufactured by the present invention.

In the above description, a case of manufacturing the intermediate component 11-1 having the shape illustrated in FIG. 2 by means of the present invention was taken as an example. However, the present invention is not limited to the case described above and is also applicable to a case of manufacturing the intermediate component 11-2 illustrated in FIG. 11(*a*) and a case of manufacturing the intermediate component 11-3 illustrated in FIG. 11(*b*), that is, the intermediate components 11-2 and 11-3 that have one of the convex ridge line 11*b*, the vertical wall 11*c*, the concave ridge line 11*d* and the flange 11*e*, respectively.

2. Manufacturing Method of the Present Invention

In the manufacturing method of the present invention, basically the intermediate component 11-1 of the press component 11 is manufactured by the free bending method using the manufacturing apparatus 20.

The press component 11 that is taken as the manufacturing object of the present invention preferably satisfies the aforementioned first case or second case. This is because, in the press component 11 that satisfies the first case or second case, cracking occurs at the portion "a" of the blank 24 when manufactured by the conventional free bending method.

That is, a portion (hatched portion 18*a* in FIG. 22) of the blank 24 to be formed into a part of the top plate 11*a* of the curved portion 13 of the press component 11 is pressed with an applied pressure that is 1.0 MPa or more and less than 32.0 MPa by the die pad 22, or while maintaining the distance of a gap between the die pad 22 and the punch 23 at a distance corresponding to 1.0 to 1.1 times the sheet thickness of the blank 24, the die pad 22 is brought adjacent to or into contact with the portion (hatched portion 18*a* in FIG. 22) to be formed into the top plate 11*a* of the curved portion 13 of the press component 11.

By this means, while suppressing out-of-plane deformation of the portion to be formed into a part of the top plate 11*a*, the intermediate component 11-1 of the press component 11 is manufactured by performing press working that is described hereunder.

That is, in the press working, in a state in which a portion of the blank 24 to be formed into the end portion 11*f* in the first direction of the top plate 11*a* is present on the same plane as a portion of the blank 24 to be formed into the top plate 11*a*, the die 21 and the punch 23 are relatively moved in directions in which the die 21 and the punch 23 approach each other.

By this means, the vertical wall 11*c*, the concave ridge line 11*d* and the flange 11*e* on the inner circumferential side of the curved portion 13 are formed while the portion of the blank 24 to be formed into the end portion 11*f* is caused to move in-plane (slide) over a portion of the die 21 at which the top plate 11*a* will be formed.

By this press working, the material inflow facilitating portion forming mechanism 25 provided in the die 21 and the punch 23 provides at least one material inflow facilitating portion 19 in the vicinity of the portion of the blank 24 to be formed into the flange 11*e* on the inner circumferential side of the curved portion 13 of the intermediate component 11-1.

According to the present invention, as described in the foregoing referring to FIG. 9, an inflow amount of the blank 24 to a portion of the blank 24 to be formed into the flange 11*e* on the inner circumferential side of the curved portion 13 of the intermediate component 11-1 increases. Therefore, in the blank 24, the tensile force F in the circumferential direction of the concave ridge line 11*d* that is located at an upperpart of the portion "a" can be reduced, and by this means cracking at the portion "a" of the blank 24 is prevented.

In a case where there is no unwanted part in the intermediate component 11-1 that underwent press working according to the free bending method by means of the manufacturing apparatus 20, the intermediate component 11-1 serves as it is as the press component 11 that is the end product. On the other hand, in a case where there is an unwanted part in the intermediate component 11-1, the intermediate component 11-1 is made into the press component 11 by cutting off (trimming) the unwanted part including the material inflow facilitating portion 19 by taking the outer edge portion of the flange 11*e* as a trim line.

Example 1

With respect to each of the intermediate component 11-1 (example embodiment of the present invention) illustrated in FIG. 2 manufactured using the manufacturing apparatus 20 illustrated in FIG. 1, and a press component (comparative example) manufactured using a manufacturing apparatus 14 illustrated in FIG. 20, a maximum sheet thickness reduction ratio at a meeting point "a" portion between the concave ridge line 11*d* and the flange 11*e* at a center position in the circumferential direction of the curved portion 13 was analyzed by the finite element method using a computer.

The specifications of the intermediate component 11-1 and the press component that were analyzed are as described hereunder:

Tensile strength and sheet thickness of blanks 24 and 18: 1180 MPa or more, and 1.6 mm Height (projection distance in product height direction of vertical wall 11*c*) of intermediate component 11-1 and press component: 60 mm Radius of curvature $R_1$ of concave ridge line 11*d* of intermediate component 11-1 and press component: 20 mm in side view Radius of curvature $R_2$ on inner side of curved portion 13 of intermediate component 11-1 and press component: 100 mm in plan view According to this analysis, if the maximum sheet thickness reduction ratio calculated by the dynamic explicit method using the finite element method was 8% or less, it was determined that there was no cracking at the aforementioned meeting point, while if the maximum sheet thickness reduction ratio that was similarly calculated was more than 13% it was determined that there was cracking at the aforementioned meeting point.

As a result, it was found that the maximum sheet thickness reduction ratio at the aforementioned meeting point "a" portion of the intermediate component 11-1 (example embodiment of the present invention) was 8% and it thus was determined that there was no cracking at the meeting point "a" portion, while in contrast it was found that the maximum sheet thickness reduction ratio at the meeting point "a" portion of the press component (comparative example) was 13% and it was thus determined that there was cracking at the meeting point "a" portion.

According to the present invention, even when press working by the free bending method is performed on the blank 24 in the aforementioned first case or second case, the L-shaped component 11-1 can be manufactured without generating cracking in the flange 11*e* on the inner circumferential side of the curved portion 13.

Example 2

With respect to intermediate components 11-1 (example embodiments of the present invention) illustrated in FIG. 2 that were manufactured using the manufacturing apparatus 20 illustrated in FIG. 1, and press components (comparative examples) manufactured using the manufacturing apparatus 14 illustrated in FIG. 20, a maximum sheet thickness reduction ratio at a meeting point "a" portion between the concave ridge line 11*d* and the flange 11*e* at a center position in the circumferential direction of the curved portion 13 was analyzed by the finite element method using a computer.

Table 1 shows a summary of the specifications of the intermediate components 11-1 and the press components that were analyzed as well as the analysis results.

According to this analysis, if the maximum sheet thickness reduction ratio of the blank 24 having a tensile strength of 980 MPa that was calculated by the dynamic explicit method using the finite element method was 15% or less it was determined that there was no cracking at the aforementioned meeting point "a" portion, and if the maximum sheet thickness reduction ratio of the blank 24 having a tensile strength of 1180 MPa that was similarly calculated was 10% or less it was determined that there was no cracking at the aforementioned meeting point.

As illustrated in Table 1, according to the present invention, even when press working by the free bending method is performed on the blank 24 in the aforementioned first case or second case, the L-shaped component 11-1 can be manufactured without generating cracking in the flange 11*e* on the inner circumferential side of the curved portion 13.

Example 3

With respect to an intermediate component 30 (example embodiment of the present invention) of a T-shaped component that is illustrated in FIG. 12 and an intermediate component 31 of a Y-shaped component illustrated in FIG. 13 that were manufactured using the manufacturing apparatus 20 illustrated in FIG. 1, a maximum sheet thickness reduction ratio at a meeting point "a" portion between a concave ridge line and a flange at a center position in the circumferential direction of a curved portion was analyzed by the finite element method using a computer.

Table 2 shows a summary of the specifications of the intermediate components 30 and 31 that were analyzed as well as the analysis results for each. Note that, the term "opening angle" in Table 2 refers to an angle θ shown in FIGS. 12 and 13.

TABLE 1

| | Forming Shape Conditions | | | | Maximum Sheet Thickness Reduction Ratio % | | |
|---|---|---|---|---|---|---|---|
| No | Material Strength MPa | Formed Height mm | Top Surface View $R_2$ mm | Concave Ridge Line $R_1$ mm | Without Material Inflow Facilitating Portion (Comparative Example) | Cracking Criterion | With Material Inflow Facilitating Portion (Example Embodiment of the Present Invention) |
| 1 | 1180 | 60 | 120 | 20 | 13 | 10 | 8 |
| 2 | 980 | 80 | 120 | 20 | 16 | 15 | 12 |
| 3 | 980 | 60 | 120 | 5 | 18 | 15 | 13 |
| 4 | 980 | 60 | 90 | 20 | 17 | 15 | 10 |
| 5 | 1180 | 65 | 150 | 20 | 14 | 10 | 9 |
| 6 | 1180 | 50 | 150 | 12 | 12 | 10 | 8 |
| 7 | 980 | 50 | 130 | 12 | 15 | 15 | 12 |
| 8 | 980 | 65 | 130 | 20 | 15 | 15 | 11 |
| 9 | 1180 | 50 | 130 | 20 | 12 | 10 | 6 |
| 10 | 980 | 65 | 150 | 12 | 15 | 15 | 10 |

TABLE 2

| | Forming Shape Conditions | | | | | Maximum Sheet Thickness Reduction Ratio % | | |
|---|---|---|---|---|---|---|---|---|
| | | | | | | Without Material Inflow | | With Material Inflow Facilitating |
| | Material Strength MPa | Formed Height mm | Top Surface View$R_2$ mm | Concave Ridge Line$R_1$ mm | Opening Angle Degree deg. | Facilitating Portion (Comparative Example) | Cracking Criterion | Portion (Example Embodiment of the Present Invention) |
| Intermediate component 30 for T-shaped component | 1180 | 60 | 120 | 20 | 90 | 14 | 10 | 9 |
| Intermediate component 31 for Y-shaped component | 1180 | 60 | 120 | 20 | 120 | 11 | 10 | 8 |

According to this analysis, if the maximum sheet thickness reduction ratio in the case of a material strength of 1180 MPa that was calculated by the dynamic explicit method using the finite element method was 10% or less it was determined that there was no cracking at the aforementioned meeting point.

As illustrated in Table 2, according to the present invention, even when press working by the free bending method is performed on the blank 24 in the aforementioned first case or second case, the intermediate component 30 for a T-shaped component and the intermediate component 31 for a Y-shaped component can be manufactured without generating cracking in the flange 11*e* on the inner circumferential side of the curved portion 13.

The invention claimed is:

1. A method for manufacturing a press component, by performing press working on a blank or a pre-formed blank disposed between a die and a die pad, and a punch that is disposed facing the die and die pad, the press component having a top plate extending in a first direction, a convex ridge line connecting to an end portion of the top plate in a direction orthogonal to the first direction, a vertical wall connecting to the convex ridge line, a concave ridge line connecting to the vertical wall, and a flange connecting to the concave ridge line, and also having a curved portion at which the convex ridge line, the vertical wall and the concave ridge line are curved in a plan view that is orthogonal to the top plate, the method comprising, when manufacturing the press component:

pressing a portion of the blank to be formed into a part of the top plate by the die pad with an applied pressure of 1.0 MPa or more and less than 32.0 MPa, or subjecting the die pad to approach or come in contact with a portion of the blank to be formed into a part of the top plate while maintaining a gap between the die pad and the punch at a distance that is not less than a sheet thickness of the blank and not more than 1.1 times the sheet thickness of the blank, and forming the vertical wall, the concave ridge line and the flange by relatively moving the die and the punch in directions in which the die and the punch approach each other while causing a portion of the blank that is to be formed into an end portion of the top plate in the first direction to move in-plane over a portion of the die at which the top plate will be formed, wherein, by the press working, in a first portion of the blank to be formed into the flange on an inner circumferential side of the curved portion or a second portion of the blank that is outside the first portion, one or more material inflow facilitating portions are provided, the material inflow facilitating portions increasing an inflow amount of material flowing into the first portion, and the material inflow facilitating portion is formed so as to protrude toward a same side as the top plate or protrude toward an opposite side to the top plate.

2. The method for manufacturing a press component according to claim 1, wherein the method satisfies at least one of the following conditions:

the blank comprises an ultra-high tensile strength steel sheet having a tensile strength of 1180 MPa or more;

a projection distance of the vertical wall in a product height direction as a height of the press component is 70 mm or more;

a radius of curvature of the concave ridge line of the press component is 10 mm or less in side view; and a radius of curvature on the inner circumferential side of the curved portion in the press component is 100 mm or less in the plan view.

3. The method for manufacturing a press component according to claim 1, wherein the method satisfies two or more of the following conditions:

the blank comprises an ultra-high tensile strength steel sheet having a tensile strength of 1180 MPa or more;

a projection distance of the vertical wall in a product height direction as a height of the press component is 55 mm or more;

a radius of curvature of the concave ridge line of the press component is 15 mm or less in side view, and a radius of curvature on an inner side of the curved portion in the press component is 140 mm or less in the plan view.

4. The method for manufacturing a press component according to claim 1, wherein:

in the blank, the material inflow facilitating portion is provided at a region that is outside of a region to be formed into the press component.

5. The method for manufacturing a press component according to claim 1, wherein:

the concave ridge line has a curved region that is included in the curved portion, and a radius of curvature on an inner circumference of the curved region is 140 mm or less in the plan view, and further wherein when a straight line that is tangent to a center position of the inner circumference of the curved region of the concave ridge line in the plan view is defined as a reference line, and a length of a line passing through a center of the material inflow facilitating portion in a cross-section that is parallel to the reference line in the plan view is defined as a cross-sectional line length, the material inflow facilitating portion has a region in which the cross-sectional line length increases as a distance from the center position increases in the plan view.

6. The method for manufacturing a press component according to claim 1, wherein:

the material inflow facilitating portion is a convex bead that is convex toward a same side as the top plate of the press component, or is a concave bead that is convex toward an opposite side to the top plate of the press component.

7. The method for manufacturing a press component according to claim 1, wherein:

the material inflow facilitating portion is provided in a stepped shape in a direction parallel to a sheet thickness direction of the blank.

8. The method for manufacturing a press component according to claim 5, wherein:

the material inflow facilitating portion has a region in which the cross-sectional line length is constant at positions having different distances from the center position in the plan view.

9. The method for manufacturing a press component according to claim 1, wherein:

the press component has a hat-shaped cross-sectional shape.

10. An apparatus for manufacturing a press component by carrying out the method according to claim 1, the apparatus comprising a die and a die pad, and a punch that is disposed facing the die and die pad, wherein:

the die and the punch comprise a material inflow facilitating portion forming mechanism which includes a recess provided in the die and a protrusion provided in the punch or a recess provided in the punch and a protrusion provided in the die; and the one or more material inflow facilitating portions by the material inflow facilitating forming mechanism.

11. The apparatus for manufacturing a press component according to claim 10, wherein:

the material inflow facilitating portion forming mechanism provides the material inflow facilitating portion at a region of the blank that is outside of a region to be formed into the press component.

12. An apparatus for manufacturing a press component by carrying out the method according to claim 5, the apparatus comprising a die and a die pad, and a punch that is disposed facing the die and die pad, wherein:

the die and the punch comprise a material inflow facilitating portion forming mechanism which includes a recess provided in the die and a protrusion provided in the punch or a recess provided in the punch and a protrusion provided in the die;

the die and the punch provide the one or more material inflow facilitating portions by the material inflow facilitating portion forming mechanism; and the material inflow facilitating portion forming mechanism forms the material inflow facilitating portion so as to have region in which the cross-sectional line length increases as a distance from the center position increases in the plan view.

13. The apparatus for manufacturing a press component according to claim 10, wherein:

the material inflow facilitating portion forming mechanism provides the material inflow facilitating portion, which is a convex bead that is convex toward a same side as the top plate of the press component, or is a concave bead that is convex toward an opposite side to the top plate of the press component.

14. The apparatus for manufacturing a press component according to claim 10, wherein:

the material inflow facilitating portion forming mechanism provides the material inflow facilitating portion in a stepped shape in a direction parallel to a sheet thickness direction of the blank.

15. The apparatus for manufacturing a press component according to claim 12, wherein:

the material inflow facilitating portion forming mechanism provides the material inflow facilitating portion so as to have a region in which the cross-sectional line length is constant at positions having different distances from the center position in the plan view.

16. The apparatus for manufacturing a press component according to claim 10, wherein:

the die, the die pad, and the punch are configured to form the press component, the press component having a hat-shaped cross-sectional shape.

* * * * *